United States Patent [19]

DeCarlo

[11] 4,142,536

[45] Mar. 6, 1979

[54] WATER PIPE

[76] Inventor: Nicholas DeCarlo, P.O. Box 256, Grosse Ile, Mich. 48138

[21] Appl. No.: 829,238

[22] Filed: Aug. 31, 1977

[51] Int. Cl.[2] ..... A24F 1/30

[52] U.S. Cl. ..... 131/173; 131/216; 131/225; D27/03

[58] Field of Search ..... 131/173, 216, 225, 192, 131/194, 206, 214, 222; D27/3

[56] References Cited

U.S. PATENT DOCUMENTS

| | | | |
|---|---|---|---|
| D. 246,391 | 11/1977 | Lefkow et al. | D27/03 |
| 848,424 | 3/1907 | Abizaid | 131/173 |
| 3,881,499 | 5/1975 | McFadden et al. | 131/222 X |

*Primary Examiner*—Stephen C. Pellegrino
*Attorney, Agent, or Firm*—Cullen, Sloman, Cantor, Grauer, Scott, & Rutherford

[57] ABSTRACT

A water pipe has a base, a top circular aperture into which projects an upright support tube secured to said base. An open-ended assembly sleeve is snugly projected for a part of its length down into said support tube with a portion of the sleeve extending thereabove. A transverse partition extends across interior of said sleeve. An elongated upright hollow body is axially aligned with said support tube and has a cylindrical base which is frictionally projected over the assembly sleeve and in engagement with the support tube as a continuation thereof. An elongated bowl support tube is projected and sealed through the wall of the support tube and extends in an acute angle thereto. A bowl adapted to receive a smoking mixture is removably mounted on said latter tube. The support tube for a portion of its height is filled with a liquid defining with said support tube above said liquid a first smoke chamber. Said body for a portion of its height above said partition is filled with a liquid defining with said body above said liquid a second smoke chamber. A flexible conduit upon the exterior of the support tube and body at one end is projected through the support tube into said first chamber. The other end of said conduit extends into said body and extends through the second smoke chamber and down into the liquid in said body.

11 Claims, 4 Drawing Figures

2
59
13
61
85
63
81
35
62
47
79
11
51
53
23
19
15
75
77
73
57
67
87
69
65
25
55
71
27
97
91
89
93
95
31
33
49
43
83
45
29
41
39
17
21

WATER PIPE

BACKGROUND OF THE INVENTION

It is known in the art to contruct a water pipe which includes a water chamber through which combustible smoking mixtures deliver a smoke which travels through a liquid chamber before being inhaled. Liquid chambers of this type have been provided in pipes in conventional and not so conventional constructions. The one example of a water pipe which provides for the passage of the smoke from a smoking mixture which has been ignited and which includes a single water chamber for cleaning the smoke and for cooling it is arranged within the pipe as in U.S. Pat. No. 3,881,499.

SUMMARY OF THE INVENTION

It is an object of the present invention to provide an improved water pipe which includes a pair of water chambers and a pair of smoke chambers respectively spaced from each other and wherein, the smoke from the combustible mixture passes through the water in a support tube and filters up through said liquid and into a first smoke chamber and wherein, a flexible conduit interconnects the first smoke chamber with a second water chamber within the body of the water pipe so that said smoke passes up through the liquid within the second water chamber and filters up through said water and into a second smoke chamber before inhalation by the user.

It is another object to provide a simple and improved water pipe which consists of a plastic upright support tube and mounted and axially aligned therewith an elongated cylindrical body which is secured to said support tube as a continuation thereof and which includes a pair of bulbous chambers, one of said bulbous chambers containing a second body of liquid through which the products of combustion pass and wherein, the second bulbous member defines a chamber to receive the finally filtered smoke products before inhalation thereof.

These and other objects will be seen from the following specification and claims in conjunction with the appended drawing.

THE DRAWING

DETAILED DESCRIPTION OF THE INVENTION

Figures 1, 2, 3, 4:
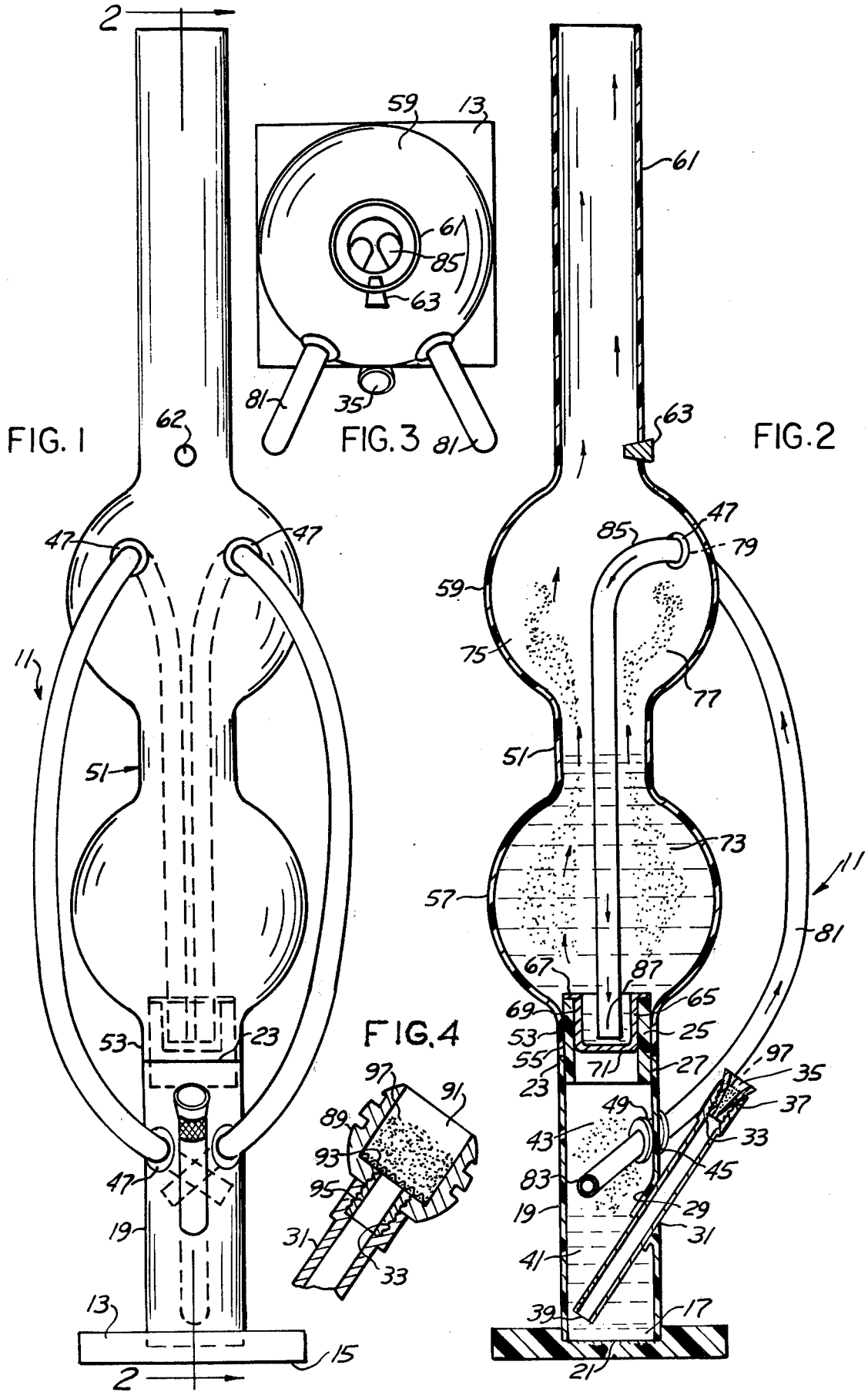
FIG. 1 is a front elevational view of the present water pipe.
FIG. 2 is a longitudinal section thereof taken in the direction of arrows 2—2 of FIG. 1.
FIG. 3 is a plan view thereof.
FIG. 4 is a fragmentary section of a modified smoking mixture bowl on an increased scale.

Referring to the drawing, the present water pipe is generally indicated at 11 and includes the rectangular base 13 having a flat support surface 15 and in its top surface a circular recess 17. The upright support tube 19 of cylindrical shape and uniform diameter, preferably constructed of an acrylic plastic at its lower end is projected down into said recess and suitably secured within said base by a suitable adhesive material 21, such as an epoxy cement. Said support tube has open end 23 at the top thereof.

Cylindrical assembly sleeve 25, preferably of a plastic material such as acrylic plastic, for a portion of its height is snugly and frictionally projected down into the support tube open end with a snug friction fit or seal as at 27. A portion of said assembly sleeve projects above the open end of the support tube.

Formed within the support tube 19 intermediate its ends is an internal angular sleeve 29 as a part thereof whose longitudinal axis extends an acute angle to the central longitudinal axis of the support tube.

Elongated bowl support tube 31, constructed of aluminum, for example, is snugly and sealingly projected through said angular sleeve so that a portion thereof extends down into the support tube adjacent the lower end thereof, as shown in FIG. 2. The tube 31 extends at an acute angle to the longitudinal axis of said support tube.

The upper end of the bowl support tube is internally threaded at 33 and is adapted to receive the removable bowl 35. Said bowl has a threaded portion 37, which is threaded down into the threaded end of the support tube. Bowl 37 receives a combustible smoking mixture.

Liquid, such as water, wine or other liquids, fills the lower portion of support tube 19 and defines thereabove the first smoke chamber 43.

A pair of spaced apertures 45 are formed through the support tube adjacent the first smoke chamber 43 and snugly receive therethrough the rubber or plastic grommets 47 whose annular groove 49 intermediate the ends thereof cooperatively receive adjacent portions of the support tube for retaining the grommets in position.

Mounted upon the support tube 19 and axially aligned therewith is an elongated body 51 also constructed of an acrylic plastic.

Said body has a cylindrical base 53 at its lower end of the same diameter as the support tube and is snugly and frictionally projected over the upper end portion of the assembly sleeve 25 and in engagement with the upper end of said support tube as a smooth continuation thereof. The friction fit of said base with respect to the assembly sleeve is designated at 55 and sufficient such as to maintain the body in a self-upstanding position as a substantially rigid continuation of the support tube, as shown in FIGS. 1 and 2.

Said body intermediate its ends and inwardly of the base 53 has formed therein a bulbous member 57 of general spherical shape. Spaced above the first bulbous member 57 is a second bulbous member 59 of the same shape and which terminates in the elongated cylindrical mouth piece 61. Said mouth piece has a diameter corresponding to the diameter of the cylindrical base 53.

Within the lower end portion of the mouth piece, there is a transverse vent aperture 62 within which is removably projected the clean out plug 63.

A partition means is snugly disposed across and sealed within the assembly sleeve 25 in order to close off the bulbous member 57. In the illustrative embodiment, the partition means is in the form of a cup 65 whose annular wall is snugly and frictionally projected down into the assembly sleeve as at 69 with a friction fit, and includes at the upper end thereof the flange 67 which bears against the top end of the assembly sleeve. The cup includes the partition defining bottom wall 71, thus, partitioning off the central portion of the assembly sleeve intermediate its ends.

The bulbous member 57 within the body is adapted to receive a quantity of liquid 73 such as water or the like, filling the bulbous member as shown in FIG. 2 and which extends down to the partition wall 71.

The quantity of liquid at 73 within the bulbous member 57 defines thereabove adjacent and within the second bulbous member 59 the second smoke chamber 75 for receiving upwardly rising smoke 77 which passes through the upwardly opening mouth piece 61.

Formed within the upper bulbous member 59 are a pair of spaced apertures 79 which receive additional grommets 47 which are suitably snap-fitted within said apertures.

The present water pipe includes a flexible conduit means which, in the illustrative embodiment, is one or more flexible plastic tubes 81 of symmetrical construction. One of said tubes is shown in FIG. 2 with its lower end portion projecting through the corresponding lower grommet 47 and into the first smoke chamber and having a smoke inlet at 83. An intermediate portion of the flexible tube upon the exterior of the body 51 is reverse-turned, extends through the upper grommet 47 and downwardly through the second smoke chamber 75 and into the liquid 73 within the bulbous member 57. The flexible tube includes outlet 87 which is spaced adjacent the lower end portion of the body 51, and adjacent the partition 71.

FIG. 4 shows a modified bowl 89 of a larger capacity than the bowl 35 and which is preferably constructed of wood and has a chamber 91 adapted to receive a combustible smoking mixture 97 which is supported upon the disc-like screen 93. Said bowl includes the depending threaded shank 95 which threadedly extends into the upper threaded end 33 of the bowl support tube 31 as a replacement for bowl 35.

OPERATION

In operation, a combustible mixture such as shown at 97, FIG. 4, when burned as in the bowl 35 delivers products of combustion which are capable of passing through the bowl support tube 31 down into the liquid 41 within the support tube 19. The smoke filters up through said liquid and into first smoke chamber 43. At a time when the user inhales on the mouth piece 61 reducing the air pressure upon the interior of the body 51, smoke within the first smoke chamber 43 passes into the inlet 83 of the flexible tube 81 and through its reverse-turned portion 85 and through the outlet 87 in said conduit which is spaced adjacent the lower end of the body 51 and above the partition 71. The products of combustion are additionally filtered through the water 73 in the bulbous member 57 and pass upwardly and accummulate as at 77 within the upper bulbous member 59 which is in communication with the mouth piece 61.

In the preferred embodiment of the invention, there is provided a pair of flexible plastic tubes, preferably transparent, such as shown in FIG. 1. The inlet ends of the respective tubes at 83 thus transmit smoke from the first chamber 43 to the lower end of the second water compartment 57 so that the smoke can move upwardly through the liquid 73 therein and filter out into the second smoke chamber 75 for communication with the mouth piece 61.

In the preferred embodiment of the invention, the present support tube 19 as well as the body 51 and its bulbous portions 57, 59 and mouth piece 61 are constructed of a transparent plastic material of a predetermined desirable color such as red, yellow, blue or green to suit the taste of the user.

Having described my invention, reference should now be had to the following claims.

I claim:

1. A water pipe comprising a base having a flat bottom support surface and a circular aperture in its top;

an upright support tube of uniform diameter having a central longitudinal axis at one end snugly projected into said aperture and secured to said base and having an upper open end;

an open ended assembly sleeve snugly and frictionally projected for a part of its length down into said tube open end, with a portion of said sleeve extending above said support tube;

a transverse partition means snugly disposed across and sealed within said sleeve;

an elongated upright hollow body axially aligned with said support tube having a cylindrical base at one end thereof of the same diameter as said support tube, snugly and frictionally projected over said assembly sleeve and into engagement with said support tube as a smooth continuation thereof;

an elongated cylindrical mouth piece at the upper end of said body and open at one end;

an elongated bowl support tube with a portion thereof projected and sealed through the wall of said support tube and extending at an acute angle to its longitudinal axis;

a bowl adapted to receive a smoking mixture mounted on said latter tube on the outer end thereof;

said support tube for a portion of its height being filled with a liquid defining with said support tube above said liquid a first smoke chamber;

said body for a portion of its height above said partition means being filled with a liquid defining with said body above said liquid a second smoke chamber extending into said mouth piece;

and a flexible conduit means upon the exterior of said support tube and body at one end projected through the wall of said support tube and into said first smoke chamber;

said conduit means being reverse-turned intermediate its ends, projected through the wall of said body with its other end extending through said second smoke chamber and down into the liquid in said body above said partition means.

2. In the water pipe of claim 1, said partition means including a cup of cylindrical shape projected into one end of said assembly sleeve with its side wall bearing against the wall of said assembly sleeve; and an annular flange at the open end of said cup overlying and supported upon said assembly sleeve.

3. In the water pipe of claim 1, said body intermediate its ends having enlarged first bulbous portion adapted to be filled with said liquid.

4. In the water pipe of claim 3, an enlarged second bulbous portion spaced from said first bulbous portion defining said second smoke chamber.

5. In the water pipe of claim 1, there being apertures in said support tube and body receiving said conduit means; and apertured sealing grommets projected through said apertures, retained upon said support tube and body, and cooperatively receiving said conduit means.

6. In the water pipe of claim 1, said flexible conduit means including a pair of spaced flexible tubes whose one ends extend into said first smoke chamber, and whose other ends extend into the liquid in said body.

7. In the water pipe of claim 1, said support tube, body, and flexible conduit means being constructed of a transparent plastic material.

8. In the water pipe of claim 1, the mounting of said bowl support tube including an inturned sleeve portion on the interior of and a part of said support tube.

9. In the water pipe of claim 1, the outer end of the bowl support tube being interiorly threaded, said bowl having a threaded shank, threaded into said tube.

10. In the water pipe of claim 9, and a screen nested in said bowl to support a smoking mixture.

11. In the water pipe of claim 1, there being a transverse vent aperture in said mouth piece; and a removable plug in said aperture.

* * * * *